US006212727B1

(12) United States Patent
Bendor

(10) Patent No.: US 6,212,727 B1
(45) Date of Patent: Apr. 10, 2001

(54) TWIST-TYPE MOP

(76) Inventor: Yarron Bendor, 8525 E. San Felipe Dr., Scottsdale, AZ (US) 85258

( * ) Notice: Subject to any disclaimer, the term of this patent is extended or adjusted under 35 U.S.C. 154(b) by 0 days.

(21) Appl. No.: 09/378,546

(22) Filed: Aug. 20, 1999

(51) Int. Cl.[7] ..... A47L 13/142
(52) U.S. Cl. ..... 15/120.1; 15/120.2
(58) Field of Search ..... 15/120.1, 120.2

(56) References Cited

U.S. PATENT DOCUMENTS

| | | | | |
|---|---|---|---|---|
| 973,491 | * | 10/1910 | Fischer, Jr. | 15/120.2 |
| 1,514,051 | | 11/1924 | Jumonville | 15/120.2 |
| 1,520,500 | * | 12/1924 | Jumonville | 15/120.2 |
| 1,710,190 | * | 4/1929 | Regan | 15/120.2 |
| 1,724,308 | * | 8/1929 | Phipps | 15/120.2 |
| 1,861,795 | * | 6/1932 | Hertzberg | 15/120.2 X |
| 3,151,475 | | 10/1964 | Johnson | 15/120.1 X |
| 4,479,278 | | 10/1984 | Heinonen | 15/120.2 |
| 5,509,163 | | 4/1996 | Morad | 15/120.2 |
| 5,566,417 | | 10/1996 | Hsiech | 15/120.2 |
| 5,577,290 | | 11/1996 | Monahan | 15/120.1 |
| 5,642,551 | | 7/1997 | Cann et al. | 15/120.1 |
| 5,722,105 | | 3/1998 | Thomasson | 15/120.2 |

* cited by examiner

*Primary Examiner*—Mark Spisich
(74) *Attorney, Agent, or Firm*—Cahill, Sutton & Thomas, PLC

(57) ABSTRACT

A twist-style mop and method, having a locking wringing grip and a lockable, adjustable, second grip. The lockable, adjustable second grip allows the size adjustment of the twist-type mop to fit a particular user.

15 Claims, 3 Drawing Sheets

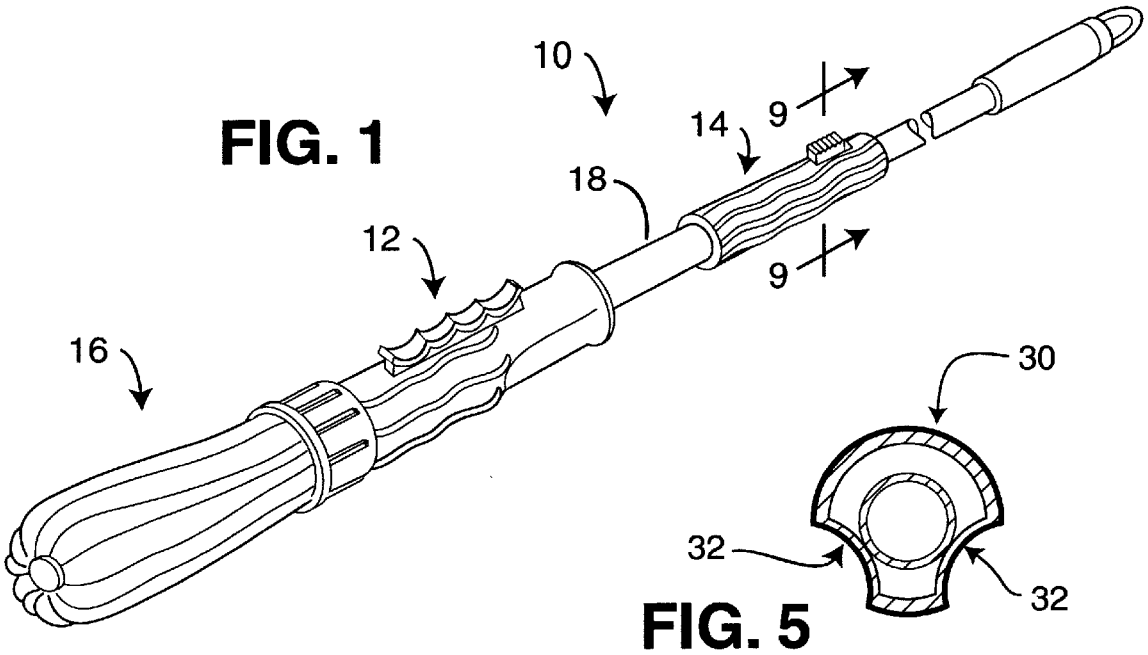
FIG. 1
FIG. 5
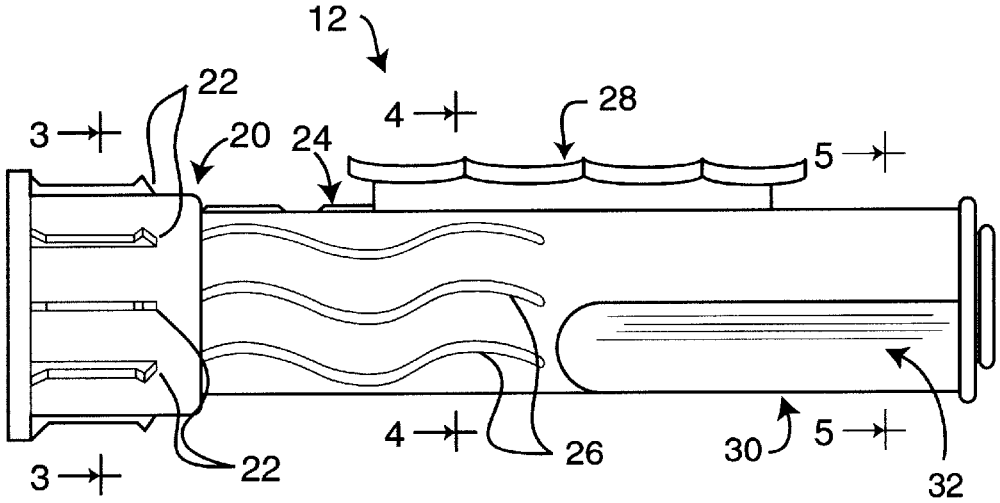
FIG. 2
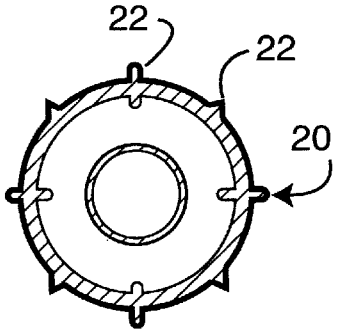
FIG. 3
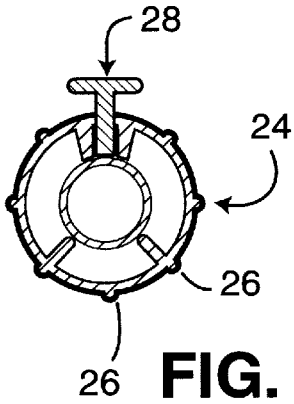
FIG. 4

TWIST-TYPE MOP

BACKGROUND OF THE INVENTION

1. Field of Invention

This invention relates generally to household cleaning apparatuses and, more specifically, to a twist-type mop having an adjustable grip and method therefor.

2. Background of the Invention

Twist-style mops are well known. Generally, they comprise a handle, a mop head located at one end of the handle, a wringing grip slidably mounted on the handle and coupled to the head, and a fixed or second grip located near the other end of the handle. Generally, in use, a person places one hand on the fixed/second grip, a second hand on the wringing grip, and wets the mop head. Once the mop head is wet, the user rotates the wringing grip so as to wring out the mop head and remove excess moisture, and then applies the mop head to the floor. All during wringing, the user retains one hand on the wringing grip and the second hand on the fixed/second grip.

In recent years, some attention has been given to improving the wringing grip. For example, U.S. Pat. No. 5,642,551 to Cann discloses a twist-type mop wherein the wringing grip has a "compressible region" thereon, so that a user may more effectively wring out excess moisture from the mop head. Similarly, U.S. Pat. No. 5,509,163 to Morad discloses a twist-type mop wherein the wringing grip has a spring and ratchet mechanism to enable more efficient wringing out of the mop head.

However, these and other efforts to improve the efficiency of the twist-type mop have ignored the fixed/second grip portion of the mop apparatus. Thus, the current twist-type mop is essentially one-size-fits all. The wringing grip and the fixed/second grip are maintained (except during actual operation of the wringing grip) at a constant distance from each other. That placement may be comfortable and efficient for one user, but uncomfortable and inefficient for another. A user having relatively shorter arms and one having relatively longer arms will, in the most optimal scenario, have different configuration requirements when it comes to the spacing of the mop grips. And yet the prior art twist-type mops do not take this into account.

Therefore, a need existed to provide a twist-type mop in which the wringing grip and the second grip can be adjusted in position relative to one another. The twist-type mop should have an efficient, locking type wringing grip for efficient wringing action, and a second grip that can be selectively locked and unlocked in a plurality of positions along the mop handle relative to the wringing grip. The twist-type mop should also incorporate gripping aids on both the wringing grip and the second grip so as to further increase efficiency and ease of use.

SUMMARY OF THE INVENTION

It is an object of the present invention to provide a twist-type mop in which the wringing grip and the second grip can be adjusted in position relative to one another.

It is a further object of the present invention to provide a twist-type mop having a second grip that can be selectively locked and unlocked in a plurality of positions along the mop handle relative to the wringing grip.

It is a still further object of the present invention to provide a twist-type mop having a locking type wringing grip and incorporating gripping aids on both the wringing grip and the second grip so as to further increase efficiency and ease of use.

BRIEF DESCRIPTION OF THE PREFERRED EMBODIMENTS

In accordance with one embodiment of the present invention, a twist-type mop is disclosed. The twist-type mop comprises, in combination: a handle having a first end and a second end; a mop head located proximate the first end of the handle; a first grip slidably and rotatably mounted on the handle proximate the mop head and coupled to the mop head; and a second grip slidably mounted on the handle proximate the second end; wherein the second grip further comprises a first locking member capable of selectively locking the second grip in one of at least two different positions along t he handle between the first grip and the second end.

In accordance with another embodiment of the present invention, a method for providing a twist-type mop is disclosed. The method comprises the steps of: providing a handle having a first end and a second end; providing a mop head located proximate the first end of the handle; providing a first grip slidably and rotatably mounted on the handle proximate the mop head and coupled to the mop head; and providing a second grip slidably mounted on the handle proximate the second end; wherein the second grip further comprises a first locking member capable of selectively locking the second grip in one of at least two different positions along the handle between the first grip and the second end.

The foregoing and other objects, features, and advantages of the invention will be apparent from the following, more particular, description of the preferred embodiments of the invention, as illustrated in the accompanying drawings.

BRIEF DESCRIPTION OF THE DRAWINGS

FIG. 1 is a perspective view of the twist-type mop of the present invention.

FIG. 2 is a side view of the wringing grip portion of the twist-type mop of FIG. 1.

FIG. 3 is a cross-sectional view of the segment of the wringing grip most proximate the mop head, taken along line 3—3 of FIG. 2.

FIG. 4 is a cross-sectional view of the segment of the non-recessed portion of the wringing grip wherein the locking member is position ed, taken a long line 4—4 of FIG. 2.

FIG. 5 is a cross-sectional view of the segment of the recessed portion of the wringing grip, taken along line 5—5 of FIG. 2.

DETAILED DESCRIPTION OF THE PREFERRED EMBODIMENTS

Figure 7:
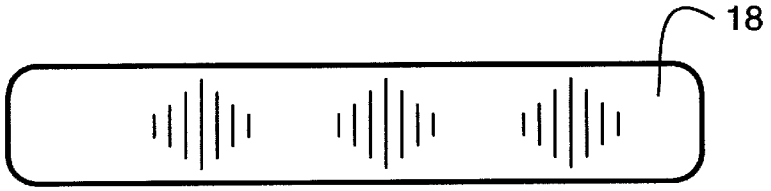
FIG. 7 is a top view of a preferred embodiment of the wringing grip locking member.

Referring to FIG. 1, reference number 10 refers generally to the twist-type mop of the present invention. The twist-type mop 10 preferably comprises a wringing grip 12, a second grip 14, and a mop head 16. The wringing grip 12 and second grip 14, as shown in FIG. 1, are mounted upon a handle 18.

Referring now to FIGS. 2–8, particular attention is made to the wringing grip 12. Referring specifically to FIG. 2, the first portion 20 of the wringing grip 12 is that most proximate the mop head 16. The first portion 20 comprises a plurality of ribs 22, which are used to secure the straps of the mop head 16. (The first portion 20 is shown in cross-section in FIG. 3.) Still referring to FIG. 2, the second portion 24 of the wringing grip 12 comprises that portion of the wringing grip 12 from the first portion 20 to that portion of the wringing grip 12 that is recessed. The second portion 24 preferably includes a plurality of raised gripping ridges 26 to make it easier to grip the wringing grip 12, and also to enhance the overall aesthetic appeal of the twist-type mop 10. The second portion 24 includes a portion of the wringing grip locking member 28. (The second portion 24 is shown in cross-section in FIG. 3.)

Still referring to FIG. 2, the third portion 30 of the wringing grip 12 abuts the second portion 24 and comprises the portion of the wringing grip 12 that includes recessed areas 32. These recessed areas 32, like the raised gripping ridges 26, help a user of the twist-type mop 10 grip the wringing grip 12 more efficiently. (The third portion 30, including the recessed areas 32, is shown in cross-section in FIG. 5.)

Figure 6:
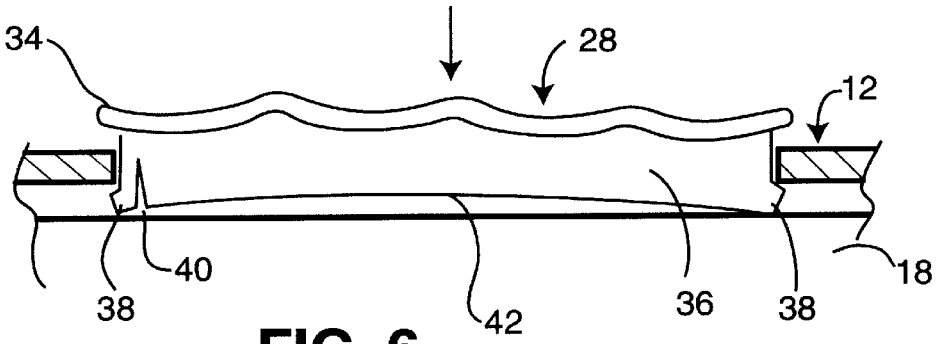
FIG. 6 is a top view of a segment of the handle of the twist-type mop of FIG. 1.
Figure 8:
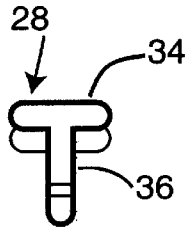
FIG. 8 is an end view of the wringing grip locking member of FIG. 7.

Referring now to FIGS. 6–8, a preferred embodiment of the wringing grip locking member 28 is shown. Referring first to FIG. 6, the locking member 28 is shown as received within the wringing grip 12. Preferably, the locking member 28 is comprised of a plastic or rubber-based material, although any suitable material allowing at least a measure of flexibility and the requisite durability could be used. The upper portion 34 of the locking member 28 is preferably dimensioned to have four concave sections to receive the four non-thumb fingers of a user's hand (not shown). Referring now to FIG. 8, as seen in end view, the locking member 28 is substantially T-shaped, with the upper portion 34 forming the top of the T and the main body 36 forming the lower portion of the T.

Referring now to FIG. 6, the main body 36 has notches 38 extending on each of the two sides thereof. Proximate one of the notches 38 is an opening 40. The combination of the notches 38 and the opening 40 allow the locking member 28 to be snapped into place within the wringing grip 12, with the opening 40 closing as the proximate notch 38 is pressed against it, reducing momentarily the length of the main body 36 and allowing it to pass through the opening in the wringing grip 12.

Still referring to FIG. 6, the bottom surface 42 of the locking member 28, which is proximate the handle 18, is concave in shape. When a user desires to activate the locking mechanism 28, he or she presses it in a downward direction toward the handle 18, causing the bottom surface 42 to deform until substantially flush with the surface of the handle 18. When the bottom surface 42 is substantially flush with the surface of the handle 18, the wringing grip 12 will be substantially locked into position relative to the handle 18. When the locking mechanism 28 is released by the user, the bottom surface 42 will resume its concave shape as shown in FIG. 6 and again the wringing grip 12 will be able to rotate and slide relative to the handle 18.

Figure 13:
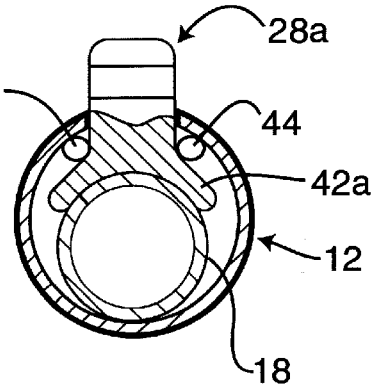
FIG. 13 is a cross-sectional view of the wringing grip of FIG. 12, taken along lines X—X thereof, illustrating another embodiment of the wringing grip locking member.
Figure 12:
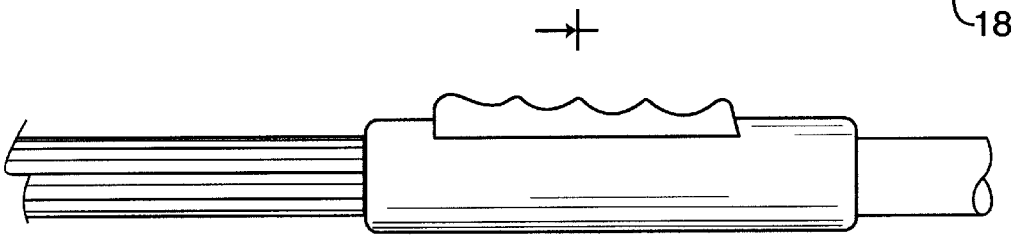
FIG. 12 is a partial side view of the wringing grip, including the locking member.
Figure 14:
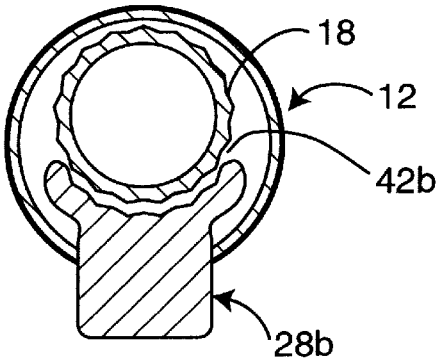
FIG. 14 is a cross-sectional view of the wringing grip of FIG, 12, taken along lines X—X thereof, illustrating another embodiment of the wringing grip locking member.

Referring now to FIGS. 12–14, two other embodiments of a locking mechanism for the wringing grip 12 is shown. Referring first to FIGS. 12–13, a locking member **28*a* is shown. In this embodiment, the bottom surface 42*a* of the locking member 28*a* is concave, and is configured to conform to the shape of the handle 18 in the manner shown in FIG. 13. Still referring to FIG. 13, the locking member 28*a* is retained in position relative to the wringing grip 12 with a pair of springs 44. (In place of springs 44, any suitable elastic/springy material may be used.) The springs 44 retain the locking member 28*a* in an open position—with the bottom surface 42*a* apart from the handle 18—until the locking member 28*a* is forced downward by a user in the manner described above. Referring now to FIG. 14, a locking member 28*b* is shown, in which the handle 18 and bottom surface 42*b* have mating, ribbed surfaces, to increase the gripping effect when the locking member 28*b* is engaged. The locking member 28*b* may be retained in position using the springs 44 as shown in FIG. 13, or as shown in FIG. 6**.

Figure 9:
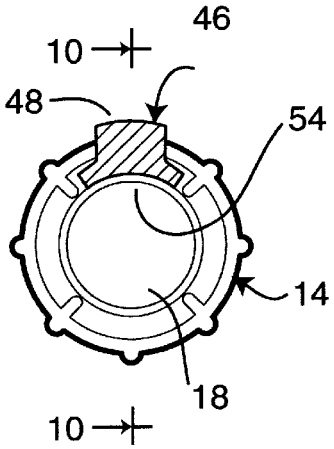
FIG. 9 is an end, cross-sectional view of the second grip locking member, taken along line 9—9 of FIG. 1.
Figure 10:
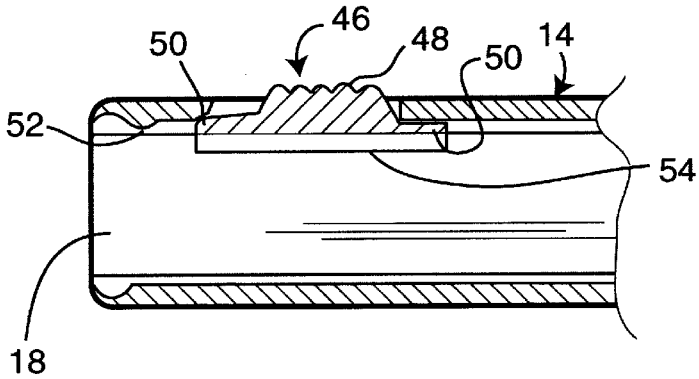
FIG. 10 is a side, cross-sectional view of the second grip locking member, taken along line 10—10 of FIG. 9.

Referring now to FIGS. 9–10, the locking mechanism 46 for the second grip 14 is shown. As shown in FIG. 10, the locking mechanism 46 comprises a gripping surface 48 that extends out from the second grip 14. The locking mechanism is retained within the second grip 14 with opposing extensions 50 that extend below the surface of the second grip 14. On at least one interior side of the second grip 14 proximate the opening through which extends the gripping surface 48, is a projection 52. The locking mechanism 46 is locked into position by the movement of that mechanism in the direction of the projection 52, which movement causes the extension 50 proximate the projection 52 to become lodged between the projection 52 and the handle 18, substantially locking the second grip 14 into position relative to the handle 18. The release of the locking mechanism 46 is accomplished by retracting the extension 50 from the space between the projection 52 and the handle 18, allowing the second grip 14 to again slide along the handle 18. As shown in FIG. 9, the bottom portion 54 of the locking mechanism 46 is preferably concave in shape, so as to conform to the shape of the handle 18 and thus to increase the efficiency of the locking action.

A user desiring to adjust the position of the second grip 14 relative to the wringing grip 12 will release the locking mechanism by placing a finger on the gripping mechanism 48, retracting the extension 50 from the space between the projection 52 and the handle 18, slide the second grip 14 toward or away from the wringing grip 12 as desired, and then return the extension 50 to the space between the projection 52 and the handle 18 once the second grip 14 is in the desired position on the handle 18 relative to the wringing grip 12.

Figure 11:
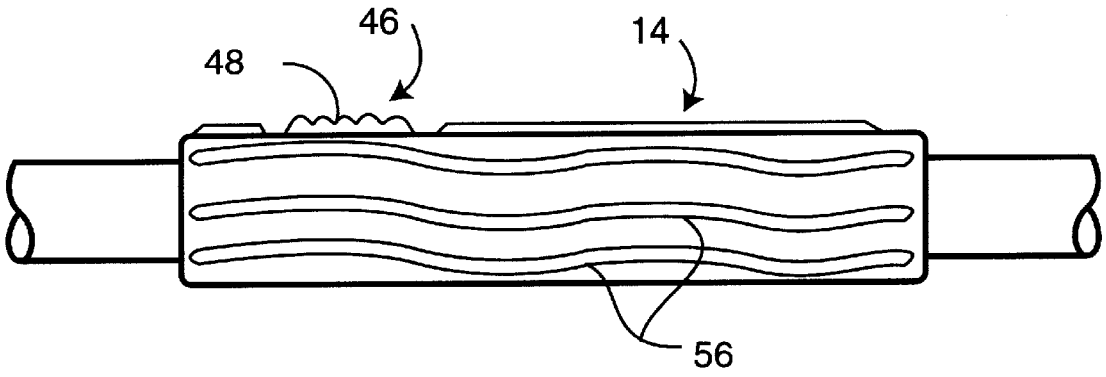
FIG. 11 is a side view of the second grip, including the locking member.

Referring now to FIG. 11, a side view of the second grip 14 is shown, with the gripping surface 48 of the locking mechanism visible. The exterior surface of the second grip 14 has located thereon a plurality of raised gripping ridges 56. Like the raised gripping ridges 26 located on the wringing grip 12, the raised gripping ridges 56 make it easier to grip the second grip 14, and also to enhance the overall aesthetic appeal of the twist-type mop 10.

While the invention has been particularly shown and described with reference to preferred embodiments thereof, it will be understood by those skilled in the art that the foregoing and other changes in form and details may be made therein without departing from the spirit and scope of the invention.

I claim:

1. A twist-type mop comprising, in combination:

a handle having a first end and a second end;

a mop head located proximate said first end of said handle;

a first grip slidably and rotatably mounted on said handle proximate said mop head and coupled to said mop head; and a second grip slidably mounted on said handle proximate said second end, said second grip comprising:

a protection located on an interior portion thereof and extending toward said handle; and a first locking member slidably retained within said second grip and capable of selectively locking said second grip in one of at least two different positions along said handle between said first grip and said second end by lodging between said projection and said handle when said first locking member is moved in the direction of said projection so as to substantially prevent sliding of said second grip along said handle.

2. The twist-type mop of claim 1 wherein said first grip further comprises a second locking member retained within said first grip and adapted to contact said handle upon activation by a user.

3. The twist-type mop of claim 1 wherein said first grip further comprises a recessed gripping portion.

4. The twist-type mop of claim 1 wherein said first grip further comprises raised gripping ridges.

5. The twist-type mop of claim 1 wherein said second grip further comprises raised gripping ridges.

6. A twist mop comprising:

a handle having a mop head located proximate a first end of the handle;

a wringing grip coupled to the mop head and to the handle such that the wringing grip is rotatably displaceable relative to the handle;

a locking member mounted on the wringing grip such that the locking member is radially displaceable between a locked position and an unlocked position, wherein in the locked position the locking member resists rotational movement of the wringing grip relative to the handle, and in the unlocked position the wringing grip is freely rotatably displaceable relative to the handle; and at least one spring member disposed between the wringing grip and the locking member for biasing the locking member into the unlocked position in the absence of a radially directed force urging the locking member into the locked position.

7. The twist mop of claim 6, wherein the locking member comprises:

an elongated gripping surface; and a braking surface coupled to the elongated gripping surface such that the braking surface frictionally engages the handle when the locking member is radially displaced from the unlocked position to the locked position.

8. The twist mop of claim 7, wherein the braking surface comprises a concave braking surface which conforms to a shape of the handle.

9. The twist mop of claim 7, wherein the braking surface comprises a ribbed surface which mates with a ribbed surface of the handle.

10. The twist mop of claim 6, further comprising a second grip mounted on the handle proximate second end of the handle and longitudinally displaceable relative to the handle, the second grip comprising a second locking member mounted on the second grip such that the second locking member is moveable between a first position in which the second grip is permitted to freely slide along the handle, and a second position in which the second locking member resists longitudinal displacement of the second grip relative to the handle.

11. The twist mop of claim 10, wherein the second locking member comprises a concave surface proximate the handle which frictionally engages the handle when the second locking member is moved from the first position into the second position.

12. The twist mop of claim 10, wherein the second grip further comprises a projection located on an interior surface of the second grip and extending toward the handle, and wherein the second locking member is lodged between the projection and the handle when the second locking member is in the second position.

13. A twist mop comprising:

a handle having a mop head located proximate a first end of the handle;

a wringing grip coupled to the mop head and to the handle such that the wringing grip is rotatably displaceable relative to the handle;

a second grip mounted on the handle proximate a second end of the handle such that the second grip is longitudinally displaceable relative to the handle; and a locking member mounted on the second grip such that the second locking member is slideable between an unlocked position and a locked position, wherein in the unlocked position the second grip is freely longitudinally displaceable in relation to the handle, and in the locked position the locking member resists longitudinal displacement of the second grip relative to the handle.

14. The twist mop of claim 13, wherein the locking member comprises a concave surface proximate the handle which is in contact with the handle when the locking member is in the locked position.

15. The twist mop of claim 13, wherein the second grip further comprises a projection located on an interior portion thereof and extending toward the handle, and wherein the locking member is lodged between the projection and the handle when the locking member is in the locked position.

* * * * *